US007780048B2

(12) United States Patent
Howell

(10) Patent No.: US 7,780,048 B2
(45) Date of Patent: Aug. 24, 2010

(54) HINGED POCKET

(76) Inventor: Frank A. Howell, 15 Cotton La., Oxford, ME (US) 04270

( * ) Notice: Subject to any disclaimer, the term of this patent is extended or adjusted under 35 U.S.C. 154(b) by 816 days.

(21) Appl. No.: 11/557,267

(22) Filed: Nov. 7, 2006

(65) Prior Publication Data

US 2008/0105722 A1 May 8, 2008

(51) Int. Cl.
*A45F 5/00* (2006.01)

(52) U.S. Cl. ..... 224/242; 224/196; 224/245; 224/247; 224/931

(58) Field of Classification Search ..... 224/193, 224/241, 242, 243, 245, 671, 676, 678, 679, 224/247, 931, 196, 914; 206/737, 738; 220/4.22, 220/4.23, 4.29; 229/123; 24/7
See application file for complete search history.

(56) References Cited

U.S. PATENT DOCUMENTS

| | | | | | |
|---|---|---|---|---|---|
| 243,144 | A * | 6/1881 | MacConnell | 224/199 |
| 404,677 | A * | 6/1889 | Blix | 224/197 |
| 1,075,587 | A * | 10/1913 | McKeen | 24/3.7 |
| 1,306,243 | A * | 6/1919 | Achtmeyer | 224/681 |
| 1,488,639 | A * | 4/1924 | Hock | 224/247 |
| 1,553,066 | A * | 9/1925 | Burger | 224/242 |
| 1,818,507 | A * | 8/1931 | Rose | 206/100 |
| 2,778,080 | A * | 1/1957 | Kernicki | 24/3.5 |
| 3,128,926 | A | 4/1964 | Stella | |
| 3,302,774 | A * | 2/1967 | Zalkind | 206/39 |
| 4,546,898 | A * | 10/1985 | Ekuan | 206/737 |
| 4,759,443 | A * | 7/1988 | Egly | 206/425 |
| 5,724,707 | A | 3/1998 | Kirk et al. | |
| 5,768,855 | A * | 6/1998 | Funawatari et al. | 53/442 |
| 5,947,279 | A * | 9/1999 | Lee et al. | 206/232 |
| 6,095,327 | A * | 8/2000 | Ikebe et al. | 206/308.3 |
| 6,154,997 | A | 12/2000 | Aluotto et al. | |
| 6,202,908 | B1 | 3/2001 | Groover | |
| 6,286,798 | B1 | 9/2001 | Chun | |
| 6,327,805 | B1 | 12/2001 | Clifton, Jr. | |
| 6,454,115 | B1 * | 9/2002 | Allasia | 220/4.23 |
| 6,604,659 | B1 | 8/2003 | Graves | |
| 6,669,023 | B2 * | 12/2003 | Kikuchi et al. | 206/759 |
| 6,883,261 | B2 | 4/2005 | Fitzpatrick | |

* cited by examiner

*Primary Examiner*—Nathan J Newhouse
*Assistant Examiner*—Steven M Landolfi, Jr.
(74) *Attorney, Agent, or Firm*—Gauthier & Connors LLP

(57) ABSTRACT

A pocket comprises an inner cup cooperating in a nested relationship with an outer cup to define a chamber having a closed bottom end and an open upper end sized to receive an article. A hinge interconnects the inner and outer cups at the closed bottom end of the chamber. The hinge is configured to accommodate swinging movement of the outer cup relative to the inner cup between a closed position at which the sides of the article received in the chamber are tightly confined between opposite interior surfaces of the inner and outer cups, and a release position deflected outwardly from the closed position to accommodate removal of the article from the chamber via its open upper end.

8 Claims, 5 Drawing Sheets

HINGED POCKET

BACKGROUND DISCUSSION

1. Field of the Invention

This invention related generally to pockets for flat-sided articles such as ammunition magazines, PDA's, telephones, radios, and the like, and is concerned in particular with an improved hinged pocket designed to accommodate rapid insertion, secure retention, and rapid retrieval of such articles.

2. Description of the Prior Art

In the military field, conventional magazine pockets are either fully closed by shielding flaps that serve to protect the magazines from exposure to dirt, dust, and other contaminants, or are partially closed by straps serving primarily to prevent the magazines from falling out, or are left open with interior cushioned surfaces serving to retain the magazines in place.

When using fully or partially enclosed pockets in dangerous areas, soldiers will usually open the tops of spare pockets by tucking their shielding flats or straps behind the magazines to facilitate easier access under duress. However, the exposed magazines are thus prone to being accidentally dislodged and lost as the soldiers maneuver vigorously during combat operations.

Moreover, once the shielding flaps of the fully enclosed pockets are tucked out of the way, magazine retrieval remains problematical. Fingers must be forced into spaces between the inside walls of the pockets and the sides of the magazines, and the magazines then pinched between the fingers and extracted. Once extracted, the magazines must be gripped to orient them properly for insertion into the weapons.

Some soldiers will tape or tie loops to the exposed magazine ends to assist them when extracting the magazines from the pockets. These loops, however, add additional cost, require additional effort to configure, and still require that the magazines be gripped during extraction in a manner that is suboptimal for rapid insertion into the weapons.

In pockets with open tops, extraction and insertion forces are directly proportional to the retention capabilities of the pocket. Thus, secure retention is unavoidably accompanied by disadvantageously high insertion and extraction forces.

SUMMARY OF THE INVENTION

The present invention overcomes the problems associated with prior art pockets, and does so in an inexpensive and reliable manner. In accordance with the present invention, a pocket comprises an inner cup cooperating in a nested relationship with an outer cup to define a chamber having a closed bottom end and an open upper end sized to receive an ammunition magazine or other like flat sided article. Hinge assemblies interconnect the inner and outer cups at the closed bottom end of the chamber. The hinge assemblies are configured to accommodate swinging movement of the outer cup relative to the inner cup between a closed position at which the flat sides of the article received in the chamber are tightly confined between opposite interior surfaces of the inner and outer cups, and a release position deflected outwardly from the closed position to accommodate removal of the article from the chamber via its open end. The outer cup is yieldably urged into its closed position by a resilient closure.

Preferably, opposite interior surfaces of the inner and outer cups are provided with friction enhancing materials positioned to contact the flat sides of an article received in the pocket chamber when the outer cup is in its closed position.

These and other features and advantages of the present invention will now be described in further detail with reference to the accompanying drawings wherein:

DETAILED DESCRIPTION

Figure 1:
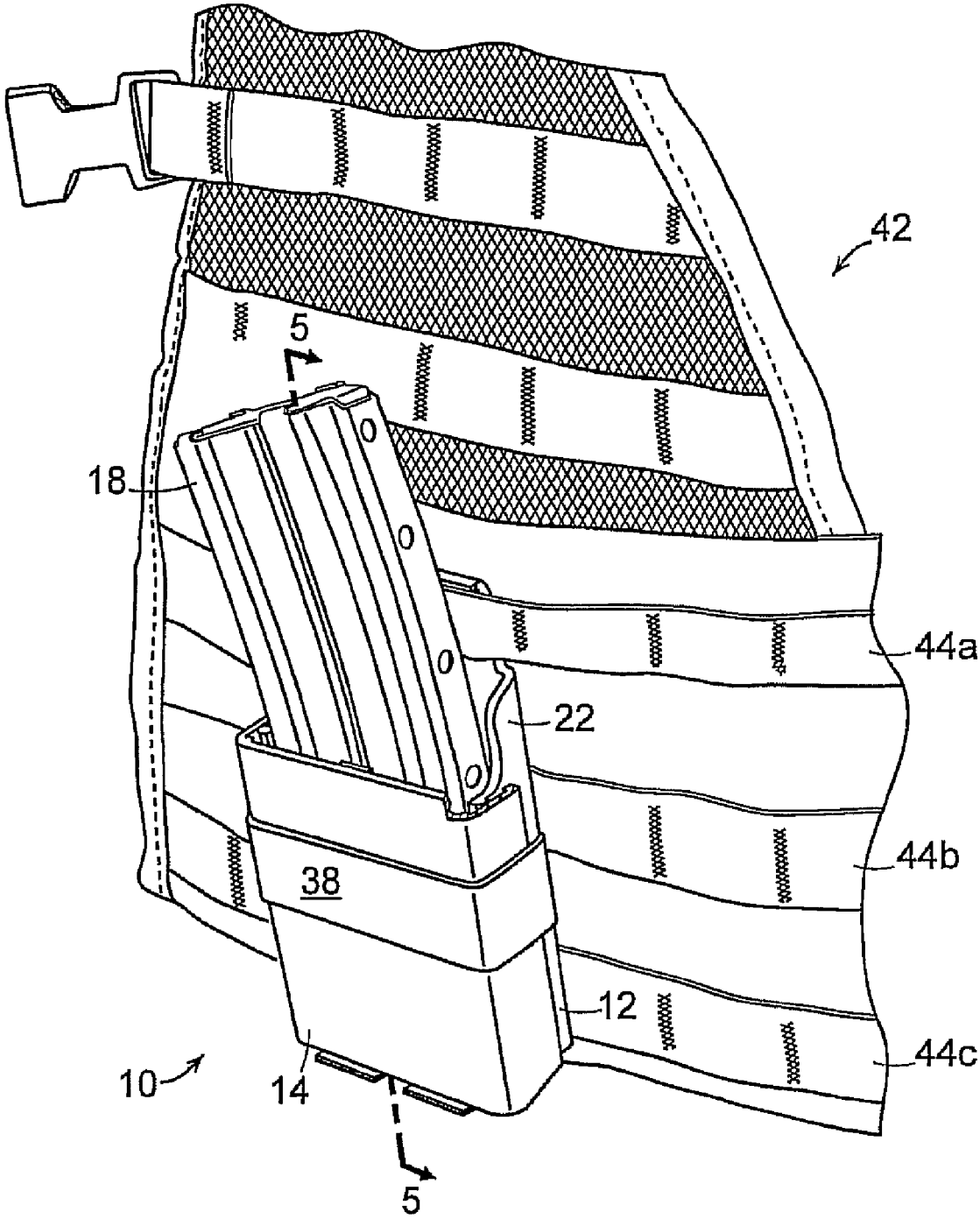
FIG. 1 is a perspective view of a pocket in accordance with the present invention, shown secured to a garment and filled with an ammunition magazine.
Figure 2:
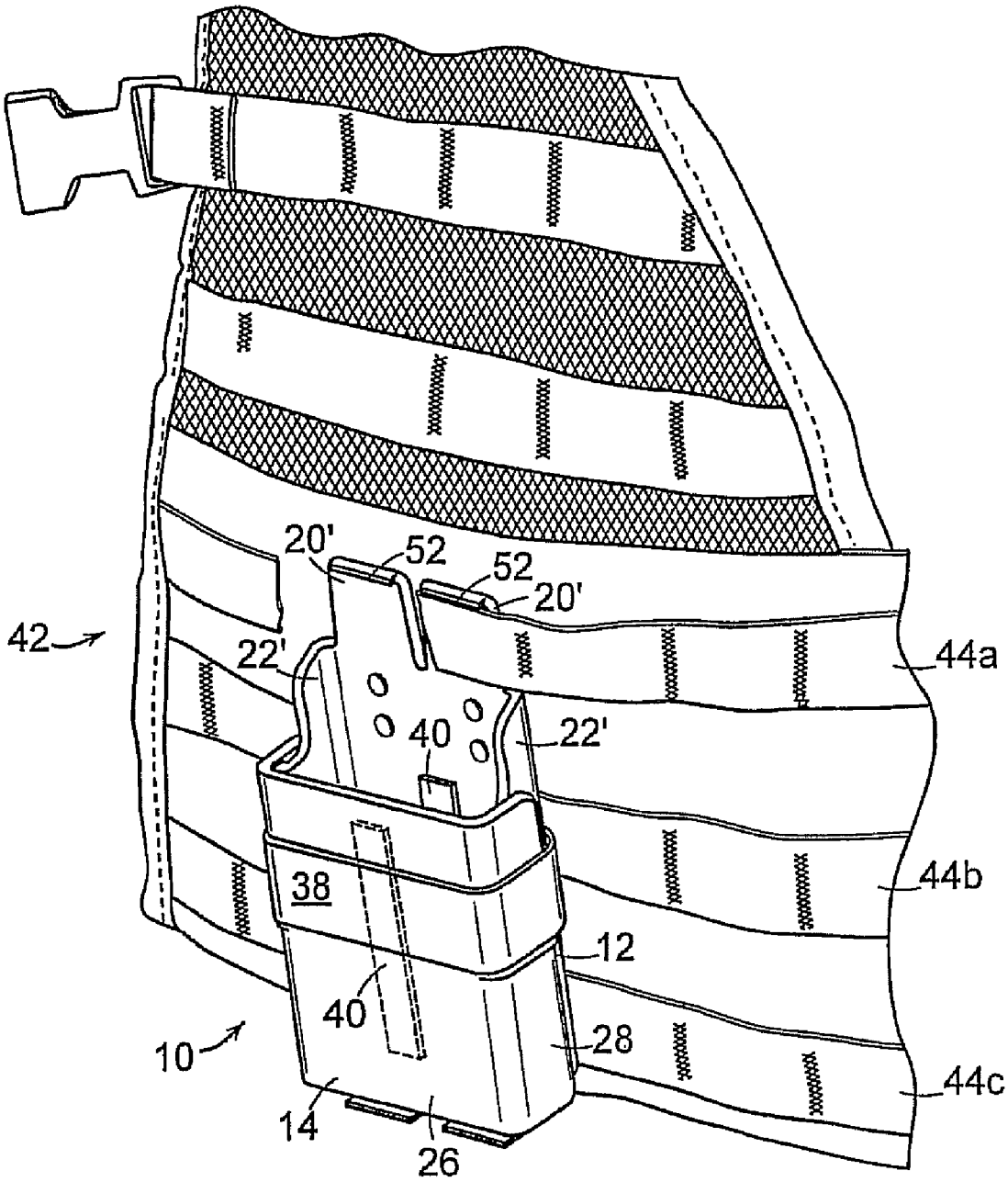
FIG. 2 is an enlarged view similar to FIG. 1, with the ammunition magazine extracted from the pocket.

With reference initially to FIGS. 1-6, a hinged pocket in accordance with the present invention is generally depicted at 10. The pocket includes an inner cup 12 cooperating in a nested relationship with an outer cup 14 to define a chamber 16 having a closed bottom end and an open upper end sized to receive an article, e.g., an ammunition magazine 18.

The inner cup 12 has a back wall 20, parallel first side walls 22 and a first bottom wall 24 extending between the first side walls 22. The outer cup 14 has a front wall 26, parallel second side walls 28 and a second bottom wall 30 extending between the second side walls 28. The second bottom wall 30 extends beneath the first bottom wall 24, with the first side walls 22 confined between the second side walls 28.

The back wall 20 is subdivided at its upper end into stabilizing tabs 20', and the first side walls 22 define upper guiding surfaces 22'. The stabilizing tabs 20' and guiding surfaces 22' project vertically above the open upper end of the chamber 16.

Figure 3:
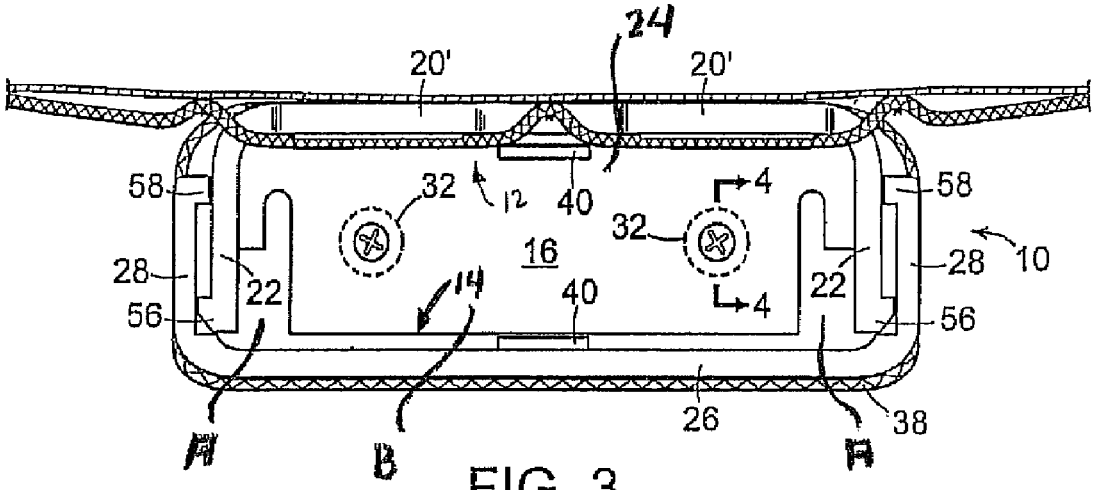
FIG. 3 is a top plan view of the empty pocket.
Figure 4:
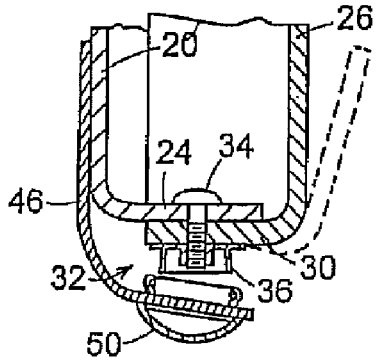
FIG. 4 is a sectional view on an enlarged scale, taken along line 4-4 of FIG. 3, and showing the snap connection of the rear mounting strap disengaged from the hinge.
Figure 5:
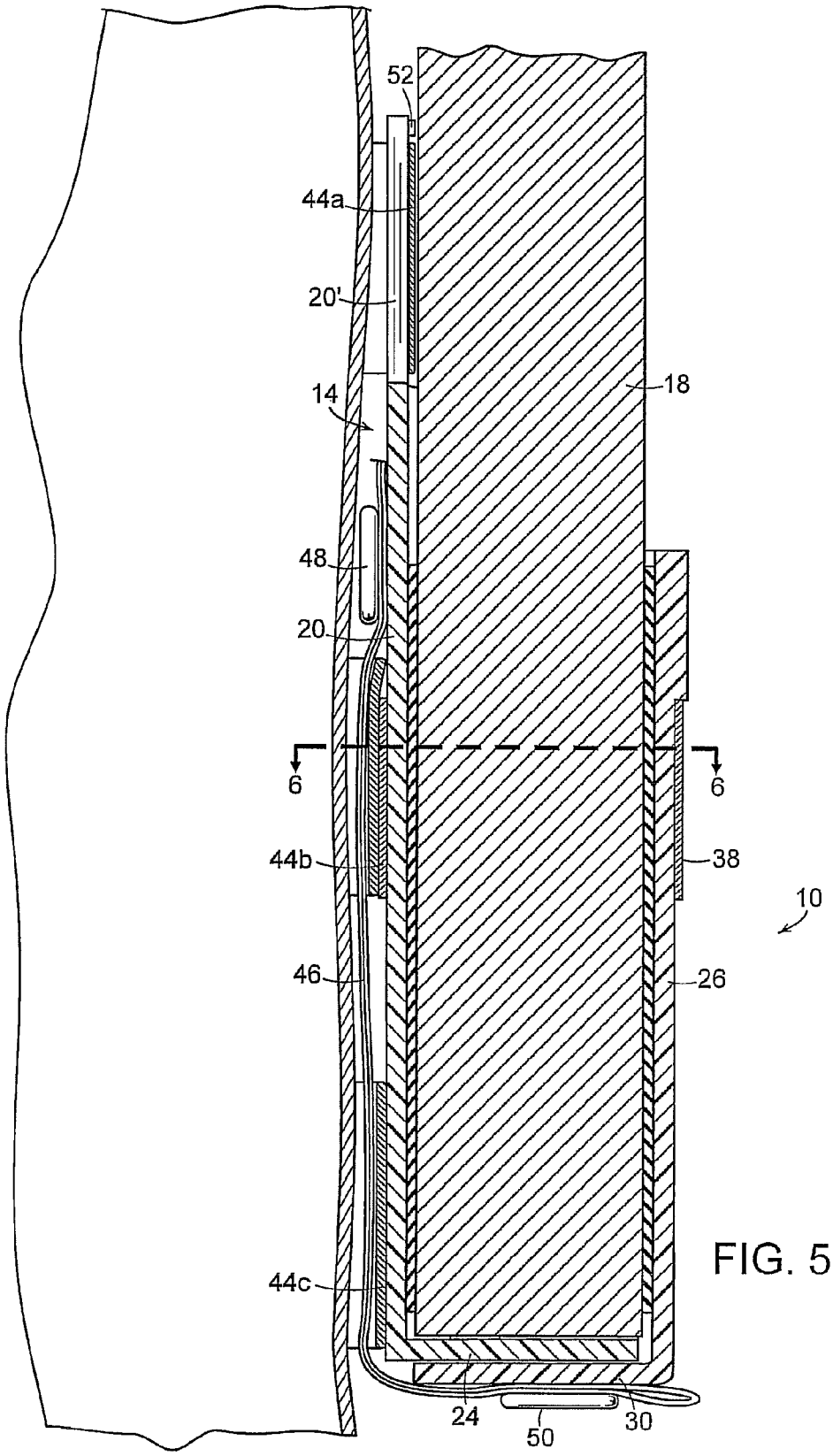
FIG. 5 is a sectional view on an enlarged scale taken along line 5-5 of FIG. 1.
Figure 6:
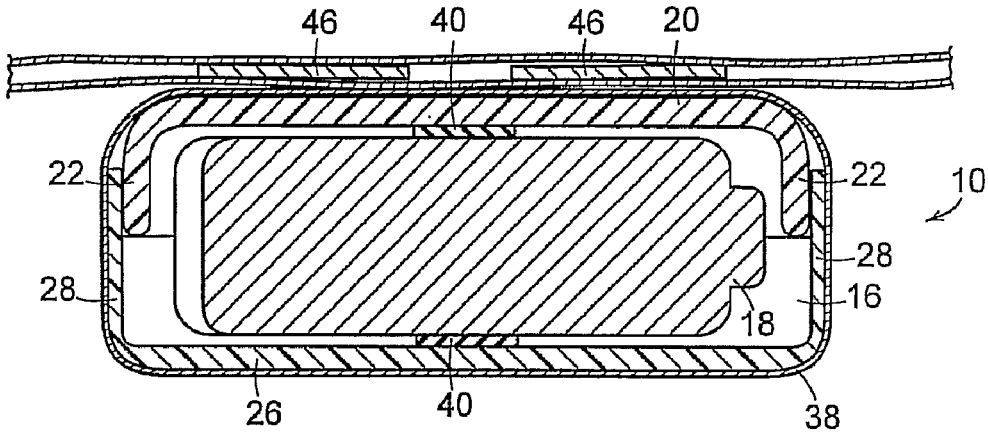
FIG. 6 is a sectional view taken along line 6-6 of FIG. 5.

As can best be seen in FIG. 3, the inner and outer cups 12, 14 are interconnected by hinge assemblies 32 at the bottom end of chamber 16. One hinge assembly is further illustrated in FIG. 4 as comprising a screw 34 extending downwardly through aligned apertures in the first and second bottom walls 24, 30. The screw is threaded into a cap 36 on the underside of the second bottom wall 30. The hinge assemblies accommodate swinging movement of the outer cup between a closed position shown by the solid lines in FIG. 4, and a release position as indicated by the broken lines in the same view.

An external elastic band 38 serves as a closure means for yieldably urging the outer cup 14 into its closed position.

The opposite interior surfaces of the front and back walls 26, 20 are advantageously provided with friction enhancing materials, preferably in the form of opposed vertical strips 40 lying approximately on the central axis of the pocket.

The pocket 10 is shown attached to a garment 42 having vertically spaced horizontal web straps 44*a*, 44*b*, and 44*c*. Mounting straps 46 are attached as at 48 to the exterior surface of the back wall 20. The mounting straps are configured and dimensioned to be threaded behind web straps 44*b* and 44*a*. The lower ends of the mounting straps have heads 50 configured for snap connection to the hinge caps 36. The stabilizing tabs 20' are configured to underlie the upper web strap 44*a*, and are provided with retention ridges 52 that overlap the upper edge of the web strap 44*a*. The stabilizing tabs 20' and the upper guiding surfaces 22' of the first side walls 22 act in concert to guide the magazine 18 as it is being inserted into the chamber 16. Once inserted, the flat sides of the magazine are securely held between the front and back walls 26, 20 with the friction enhancing strips 40 serving to stabilize and prevent the magazine from being accidentally dislodged.

Figure 7:
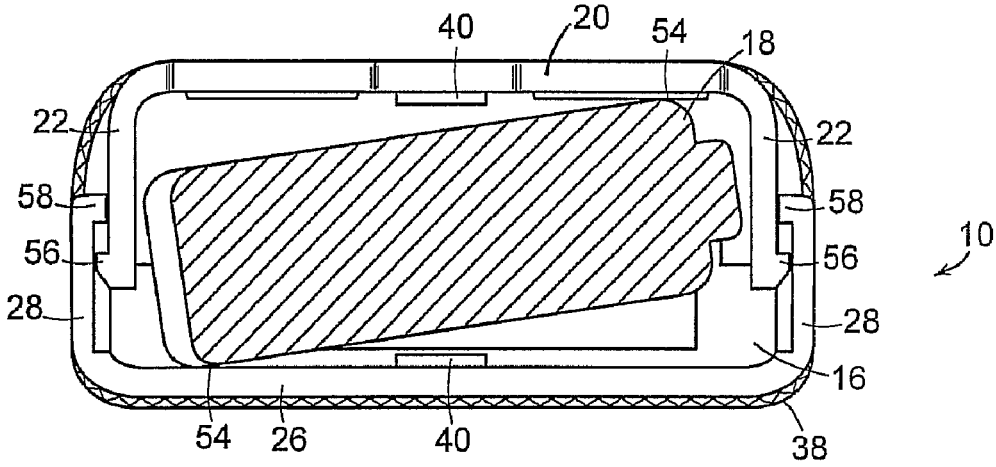
FIG. 7 is a view similar to FIG. 3 showing the magazine twisted to deflect the outer cup outwardly.

In order to extract the magazine, and as shown in FIG. 7, it is simply twisted, causing its corners to contract the front and back walls as at 54. This serves to outwardly deflect the outer cup 14, with an accompanying separation of the friction strips 40 from the flat sides of the magazine. The magazine may then be withdrawn from the chamber 16.

The first side walls 22 of the inner cup 12 are provided with laterally outwardly projecting hook-shaped segments 56 designed to coact with laterally inwardly projecting shoulders 58 on the second side walls 28 of the outer cup 14 to thereby limit the extent to which the outer cup can be deflected, thus safeguarding the external elastic band 38 from being overstressed.

Instead of twisting the magazine, as shown in FIG. 7, it may alternatively be pulled forward. This will again deflect the outer sup outwardly, and cause the rear friction strip to separate from the magazine, thus halving the total frictional resistance of the strips to extraction. As a further alternative, the magazine may simply be pulled upwardly, albeit with a greater force required to overcome the resistance of both friction strips.

Although the hinged pocket 10 of the present invention has been described with reference to ammunition magazines, it will be appreciated by those skilled in the art that this is but an exemplary use, and that other flat sided articles such as PDA's, telephones, radios and the like may readily be accommodated.

It will also be understood that various modifications to the disclosed embodiment are possible without departing from the spirit and scope of the invention. Non limiting examples of such modifications include differently designed hinge assemblies which not only accommodate swinging movement of the outer cup, but also serve to resiliently urge the outer cup into its closed position. Also, internal spring-loaded mechanisms may be substituted for the external elastic band.

I claim:

1. A pocket for an article having oppositely facing sides, said pocket comprising:

an inner cup comprising a back wall with parallel first side walls and a first bottom wall projecting forwardly therefrom;

an outer cup comprising a front wall with parallel second side walls and a second bottom wall projecting rearwardly therefrom, said inner and outer cups cooperating in a nested relationship to define a chamber having an open upper end, with said front and back walls in a confronting relationship, with said first side walls confined between said second side walls, and with said first bottom wall overlapping and supported on said second bottom wall;

hinge means for interconnecting said first and second bottom walls, said hinge means projecting through and cooperating with said first and second bottom walls to accommodate deflection of said outer cup relative to said inner cup between a normally closed position in which an article received in said chamber has a portion thereof projecting through said open upper end and in which resistance to removal of said article from said chamber is provided by a tight confinement of the sides of said article between and in contact with said front and back walls, and a release position deflected outwardly from said closed position to relieve said resistance and to accommodate removal of said article from said chamber via said open end.

2. The pocket of claim 1 wherein said back wall and said first side walls project vertically above the open upper end of said chamber.

3. The pocket of claim 1 wherein said first and second side walls are fixed respectively to said back and front walls, with interengaging surfaces on said first and second side walls configured to limit the extent to which said outer cup may swing into said release position.

4. The pocket of claim 1 further comprising an elastic element surrounding said inner and outer cups, said elastic element serving to yieldably urge said outer cup into said closed position.

5. The pocket of claim 1 wherein confronting interior surfaces of said front and back walls are provided with friction enhancing materials positioned to contact the sides of said article when said outer cup is in said closed position.

6. The pocket of claim 5 wherein said friction enhancing materials are configured as vertical strips lying approximately on a central axis of said pocket.

7. The pocket of claim 1 further comprising flexible mounting straps on the exterior side of said back wall, said mounting straps being configured and dimensioned to be interlocked with vertically spaced horizontal web straps on a garment or the like.

8. The pocket of claim 7 wherein said back wall includes vertically projecting stabilizer tabs arranged to underlie one of said web straps.

* * * * *